US007684714B2

(12) United States Patent
Kamoshida

(10) Patent No.: US 7,684,714 B2
(45) Date of Patent: Mar. 23, 2010

(54) IMAGE FORMING DEVICE

(75) Inventor: Shinichi Kamoshida, Shiajiri (JP)

(73) Assignee: Seiko Epson Corporation, Tokyo (JP)

( * ) Notice: Subject to any disclaimer, the term of this patent is extended or adjusted under 35 U.S.C. 154(b) by 457 days.

(21) Appl. No.: 11/746,507

(22) Filed: May 9, 2007

(65) Prior Publication Data

US 2007/0264034 A1 Nov. 15, 2007

(30) Foreign Application Priority Data

May 10, 2006 (JP) ..... 2006-131071

(51) Int. Cl.
*G03G 15/00* (2006.01)

(52) U.S. Cl. ..... 399/25; 399/50

(58) Field of Classification Search ..... 399/9, 399/24, 25, 26, 38, 48, 50
See application file for complete search history.

(56) References Cited

U.S. PATENT DOCUMENTS 7,403,723 B2 * 7/2008 Moriya et al. ..... 399/26
7,590,365 B2 * 9/2009 Miyaji et al. ..... 399/50

FOREIGN PATENT DOCUMENTS

| | | |
|---|---|---|
| JP | 2001-324850 | 11/2001 |
| JP | 2002-365984 | 12/2002 |
| JP | 2003-208062 | 7/2003 |
| JP | 2005-078015 | 3/2005 |

* cited by examiner

*Primary Examiner*—Hoan H Tran
(74) *Attorney, Agent, or Firm*—Hogan & Hartson LLP

(57) ABSTRACT

An image forming device. A direct voltage power supply is independently provided for each charging device for each color, and an alternating voltage power supply is commonly provided to the charging device for each color. A current detecting section detects current which flows between each image carrying body and each charging device. A control device judges that the image carrying body is damaged when a detected current value is not less than a preliminarily set specified value when a direct voltage is sequentially independently applied to the charging device for each color when leakage of charging voltage is generated.

4 Claims, 7 Drawing Sheets

IMAGE FORMING DEVICE

BACKGROUND

1. Technical Field

The present invention relates to a technical field of an image forming device such as an electrophotographic device, an electrostatic copier, a printer, a facsimile, and the like in which a DC power supply for a process unit for each color is independently arranged and an AC power supply is commonly arranged for the process units for three colors in the full-color image forming device of a tandem type.

2. Related Art

Heretofore, as an image forming device of a plurality of colors or full-color of an electrophotographic system, so cold an image forming device of a tandem type has been proposed in which a photoreceptor is arranged in a tandem manner in accordance with for each color and a toner image of each color formed on each photoreceptor is sequentially overlapped on an intermediate transfer medium or a transfer material in order to form a color image (for example, see JP-A-2001-324850 (hereinafter, referred to as Patent Document 1)).

A charging voltage in which AC voltage and DC voltage are superimposed is applied to a charging roller in the charging device for each color in the image forming device of a tandem type disclosed in Patent Document 1. In this case, an AC voltage power source and a DC voltage power source are respectively independently arranged for each color.

However, in the image forming device disclosed in Patent Document 1, the AC voltage power supply and DC voltage power source are respectively independently arranged for each color, so that there are various problems in that a number of parts is increased, cost is increased, the size of the image forming device is increased, and the control thereof is complicated, or the like.

Consequently, in order to correspond with the various problems described above, the AC voltage power supply may be commonly provided to each process unit for three colors (yellow Y color, magenta M color, cyan C color) There is little possibility that the leakage of charging voltage is generated at the time when the photoreceptor is charged by the charging roller in the case where such an image forming device of tandem type is ordinarily used. However, when another object is contacted to the surface of the photoreceptor and damaged when the process unit including the photoreceptor is replaced by user, leakage is generated at the time of printing process and image forming defect is generated. Accordingly, it is necessary to replace the process unit in which leakage is generated. However, commonly providing the AC voltage power supply for each process unit for three colors makes it difficult to identify the process unit in which leakage is generated.

SUMMARY

An advantage of some aspects of the invention is that it provides an image forming device of a tandem type which makes it possible to surely and easily identify an image carrying body in which leakage is generated while providing reduction of the number of parts, reduction of cost, downsizing of the image forming device, and easiness of the control thereof.

According to an aspect of the invention, an image forming device is provided in which image carrying bodies on which an electrostatic latent image is respectively formed in accordance with for each a plurality of colors are arranged in a tandem manner, in which a charging voltage in which an alternating voltage and a direct voltage are superimposed is applied to charging devices which respectively charge each image carrying body, and in which a color image is formed by sequentially overlapping a toner image of each color formed on each image carrying body on an intermediate transfer medium or a transfer material. A direct voltage power supply for applying a direct voltage to the charging device for each color is independently provided for each charging device for each color, and an alternating voltage power supply for applying an alternating voltage to the charging device for each color is commonly provided to the charging device for each color. A current detecting section for detecting a current which flows between the each image carrying body and the each charging device is provided. A control device is provided which judges that the image carrying body is damaged when a current value detected by the current detecting section is not less than a preliminarily set specified value when a direct voltage is sequentially independently applied to the charging device for each color when leakage of charging voltage is generated.

It is preferable that the direct voltage respectively sequentially independently applied to the charging device for each color when leakage of charging voltage is generated is continuously changed from 0 V.

Further, it is preferable that an image carrying body for block is further arranged in a tandem manner to each image carrying body for the plurality of colors, and a direct voltage power supply and an alternating voltage power supply for applying a direct voltage and an alternating voltage to the charging device to the image carrying body for black are respectively independently provided from the direct voltage power supply and the alternating voltage power supply to each image carrying body for the plurality of colors.

Further, it is preferable that the each image carrying body is respectively constituted as a process unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best mode for carrying out the invention will be described below with reference to the accompanying drawings.

Figure 1:
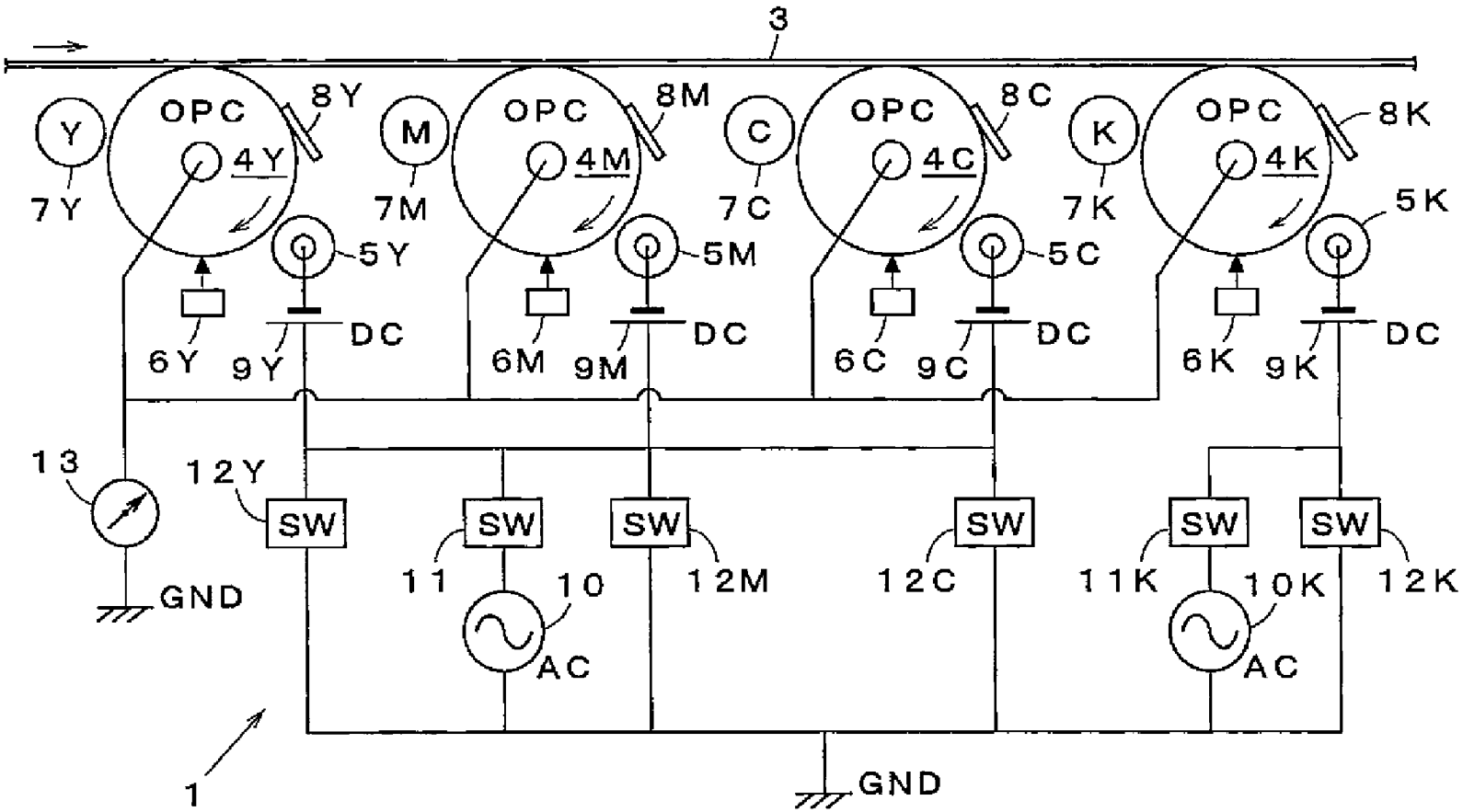
FIG. 1 is a diagram schematically and partially showing an example of an embodiment of an image forming device according to the invention.

FIG. 1 is a diagram schematically and partially showing an example of an embodiment of an image forming device according to the invention.

As shown in FIG. 1, an image forming device 1 of the example is equipped with at least each process unit 2Y, 2M, 2C, 2K for yellow (Y) color, magenta (M) color, cyan (C) color, and black (K) color, and an intermediate transfer belt 3.

Each process unit 2Y, 2M, 2C, 2K is arranged in a tandem manner in the order of Y color, M color, C color, K color from the upstream side toward the downstream side of the moving direction of the intermediate transfer belt 3 (from left side toward right side in FIG. 1). Note that the arrangement order for each color is not restricted to this and any arrangement order may be employed. However, in the description described below, each process unit 2Y, 2M, 2C, 2K shown in FIG. 1 shall be arranged in this order.

Each process unit 2Y, 2M, 2C, 2K is equipped with corresponding one of photoreceptors (OPC) 4Y, 4M, 4C, 4K, charging devices 5Y, 5M, 5C, 5K, exposure devices 6Y, 6M, 6C, 6K, developing devices 7Y, 7M, 7C, 7K, and cleaning devices 8Y, 8M, 8C, 8K. Each of the photoreceptors 4Y, 4M, 4C, 4K, is an image carrying body on which an electrostatic latent image and a toner image of each color are formed. Each of the charging devices 5Y, 5M, 5C, 5K is respectively equipped with a charging roller for performing non-contact charging. The charging device 5Y, 5M, 5C, 5K, the exposure device 6Y, 6M, 6C, 6K, the developing device 7Y, 7M, 7C, 7K, and the cleaning device 8Y, 8M, 8C, 8K are respectively sequentially arranged around the photoreceptor 4Y, 4M, 4C, 4K from the upstream side of the rotating direction of the photoreceptor 4Y, 4M, 4C, 4K (clockwise in FIG. 1).

In the image forming device 1 of the example, similarly to the image forming device of a conventional tandem type, an electrostatic latent image is formed on each photoreceptor 4Y, 4M, 4C, 4K by each exposure device 6Y, 6M, 6C, 6K after each photoreceptor 4Y, 4M, 4C, 4K is uniformly charged without contact by each charging roller of each charging device 5Y, 5M, 5C, 5K. Further, each electrostatic latent image on each photoreceptor 4Y, 4M, 4C, 4K is respectively developed by each developing device 7Y, 7M, 7C, 7K and a toner image is formed on each photoreceptor 4Y, 4M, 4C, 4K. Then, the toner image of each color on each photoreceptor 4Y, 4M, 4C, 4K is sequentially overlapped in color to be primary transferred to the intermediate transfer belt 3 and a full-color toner image is formed on the intermediate transfer belt 3. The full-color toner image on the intermediate transfer belt 3 is secondary transferred to a transfer material such as a transfer paper by a conventionally known secondary transfer device not shown and thereafter the toner image on the transfer material is fixed by a conventionally known fixing device also not shown, and a full-color toner image is formed on the transfer material. A toner and a foreign object remained on each photoreceptor 4Y, 4M, 4C, 4K are removed by each cleaning device 8Y, 8M, 8C, 8K after the primary transfer to the intermediate transfer belt 3.

Incidentally, in the image forming device 1 of the example, a charging voltage in which an alternating-current voltage (AC) and a direct-current voltage (DC) are superimposed is to be applied to each charging device 5Y, 5M, 5C, 5K as shown in FIG. 1. In this case, a separate DC voltage power supply 9Y, 9M, 9C is connected to each charging device 5Y, 5M, 5C for three colors of Y color, M color, and C color, and one common AC voltage power supply 10 is connected in series to each DC voltage power supply 9Y, 9M, 9C. Further, a DC voltage power supply 9K and an AC voltage power supply 10K which are independent from each DC voltage power supply 9Y, 9M, 9C and each AC voltage power supply 10Y, 10M, 10C for Y color, m color, and C color are connected in series to the charging device 5K for K color.

In addition, one common switch 11 for applying a charging voltage in which a DC voltage and an AC voltage are superimposed to each charging device 5Y, 5M, 5C for Y color, M color, and C color is provided, and one switch 11K for applying a charging voltage in which a DC voltage and an AC voltage are superimposed to the charging device 5K for K color is provided. Further, three switches 12Y, 12M, 12C for respectively applying only a DC voltage to each charging device 5Y, 5M, 5C for Y color, M color, and C color are separately independently provided, and one switch 12K for applying only a DC voltage to the charging device 5K for K color is provided. Further, one common ammeter 13 for detecting a current which flows between each photoreceptor 4Y, 4M, 4C, 4K and each charging device 5Y, 5M, 5C, 5K for Y color, M color, C color, and K color is provided between each photoreceptor 4Y, 4M, 4C, 4K and a grounding (GND). All of each switch 11, 11K, 12Y, 12M, 12C, 12K and the ammeter 13 are connected to a controller (CPU; a controller of the invention) of the image forming device 1.

Next, in the image forming device 1 of the example, identification of the process unit in which charging voltage is leaked will be described.

When image defect caused by leakage of charging voltage is discovered in the image formed on a transfer material when image forming operation is performed by user, it is impossible to identify the process unit in which leakage is generated. Accordingly, a check button (not shown) for identifying the process unit in which leakage is generated is provided on an operating panel (not shown) of the image formatting device 1. In the image forming device 1, operation of the check button by user allows the CPU to identify the process unit in which leakage is generated and to display the identified process unit on a display device (user interface) of the operating panel of the image forming device 1.

Next, identification method of the process unit in which leakage is generated will be described. FIG. 2 to FIG. 5 each is a diagram showing a flow for performing the identification method.

Figure 2:
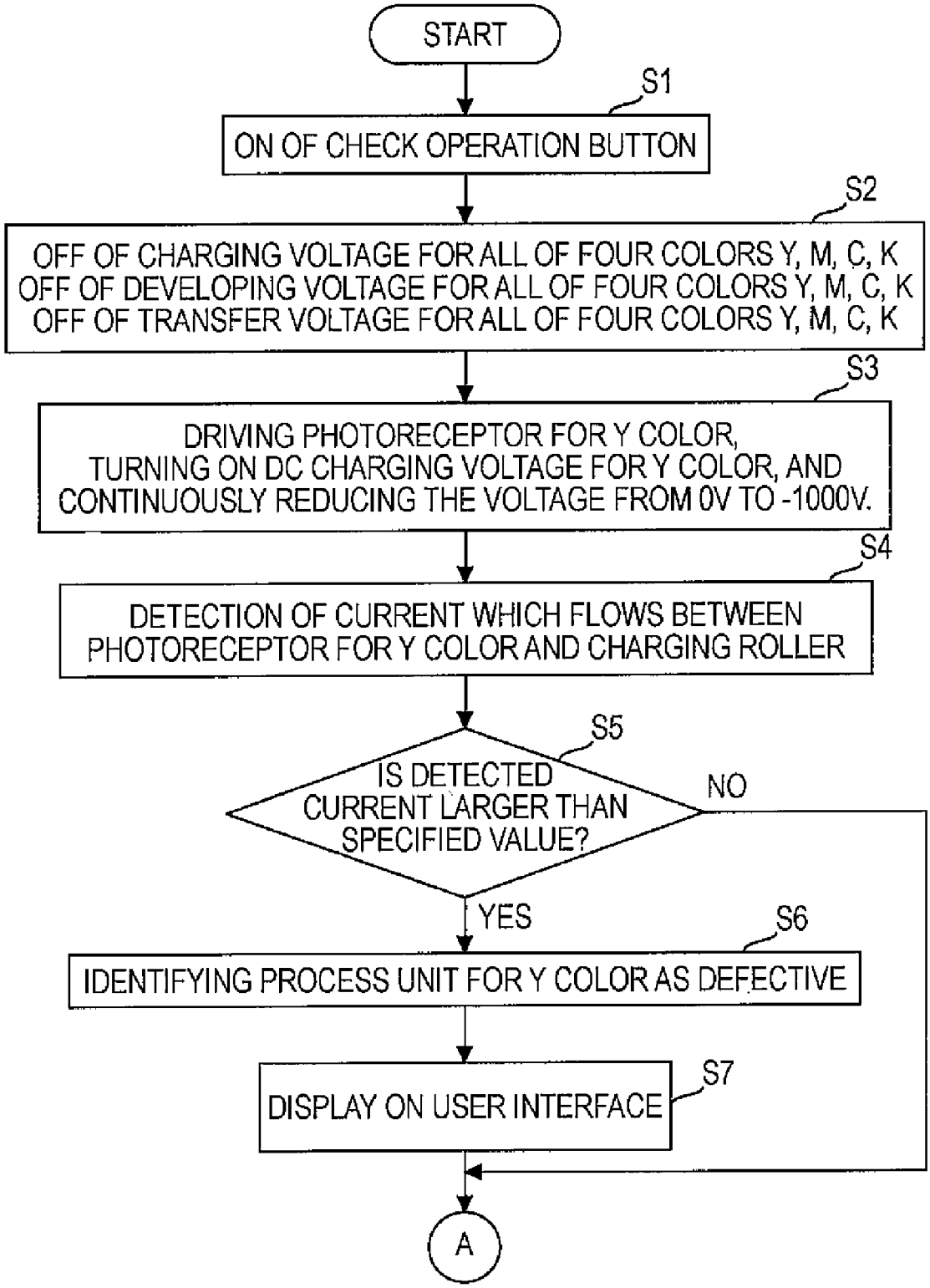
FIG. 2 is a diagram showing a part of a flow for performing an identification method of a process unit in which leakage is generated.

As shown in FIG. 2, when a bad image is found out, user operates the check button and turns the check button on in step S1. Then, all of the charging voltage, developing voltage, and transfer voltage for all four colors of Y color, M color, C color, and K color are turned off in step S2. Then, the photoreceptor 4Y for Y color is driven, and the switch 12Y for Y color is turned on to apply the charging voltage of only DC voltage to the charging device 5Y in step S3. In this case, the DC charging voltage is continuously reduced from 0 V to −1000 V.

Next, the current flowing between the photoreceptor 4Y and the charging roller of the charging device 5Y for Y color is detected by the ammeter 13 in step S4 and whether the detected current value is larger or not than a preliminarily set specified value is judged in step S5. When judged that the detected current value is larger than the specified value, the process unit 2Y for Y color is identified as a defective in step S6 and the result is displayed on the user interface in step S7. Herewith, the user can find out that the process unit in which leakage is generated is at least the process unit 2Y for Y color.

Figure 3:
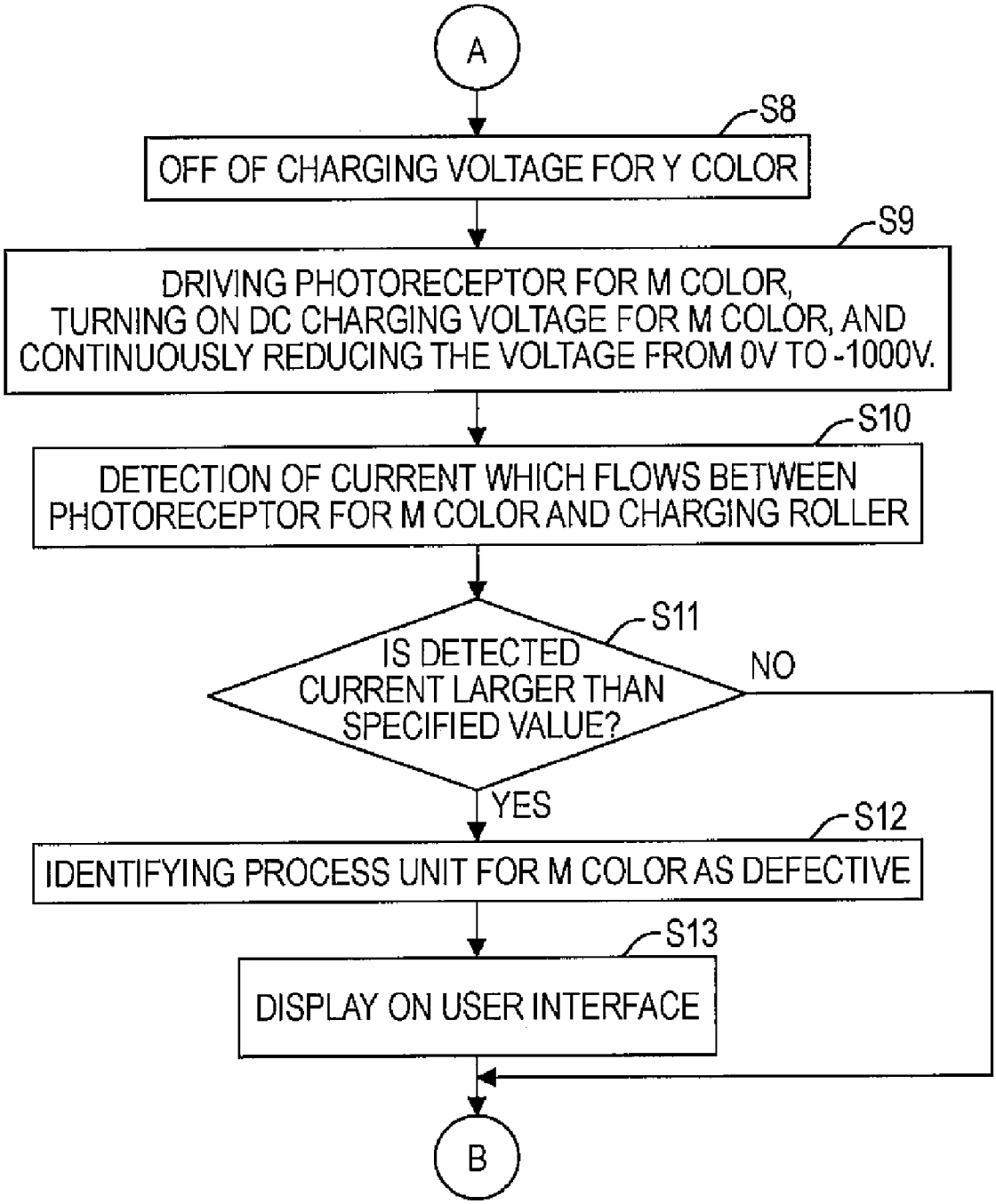
FIG. 3 is a diagram showing another part of the flow for performing the identification method of a process unit in which leakage is generated.

Then, the DC charging voltage for Y color is turned off in step S8 as show in FIG. 3. When judged that the detected current value is not more than the specified value in step S5, then goes to step S8. Then, the photoreceptor 4M for M color is driven, and the switch 12M for M color is turned on to apply the charging voltage of only DC voltage to the charging device 5M in step S9. In this case, the DC charging voltage is similarly continuously reduced from 0 V to −1000 V.

Next, the current flowing between the photoreceptor 4M and the charging roller of the charging device 5M for M color is detected by the ammeter 13 in step S10 and whether the detected current value is larger or not than the preliminarily set specified value is judged in step S1. When judged that the detected current value is larger than the specified value, the process unit 2M for M color is identified as a defective in step S12 and the result is displayed on the user interface in step S13. Herewith, the user can find out that the process unit in which leakage is generated is at least the process unit 2M for M color.

Figure 4:
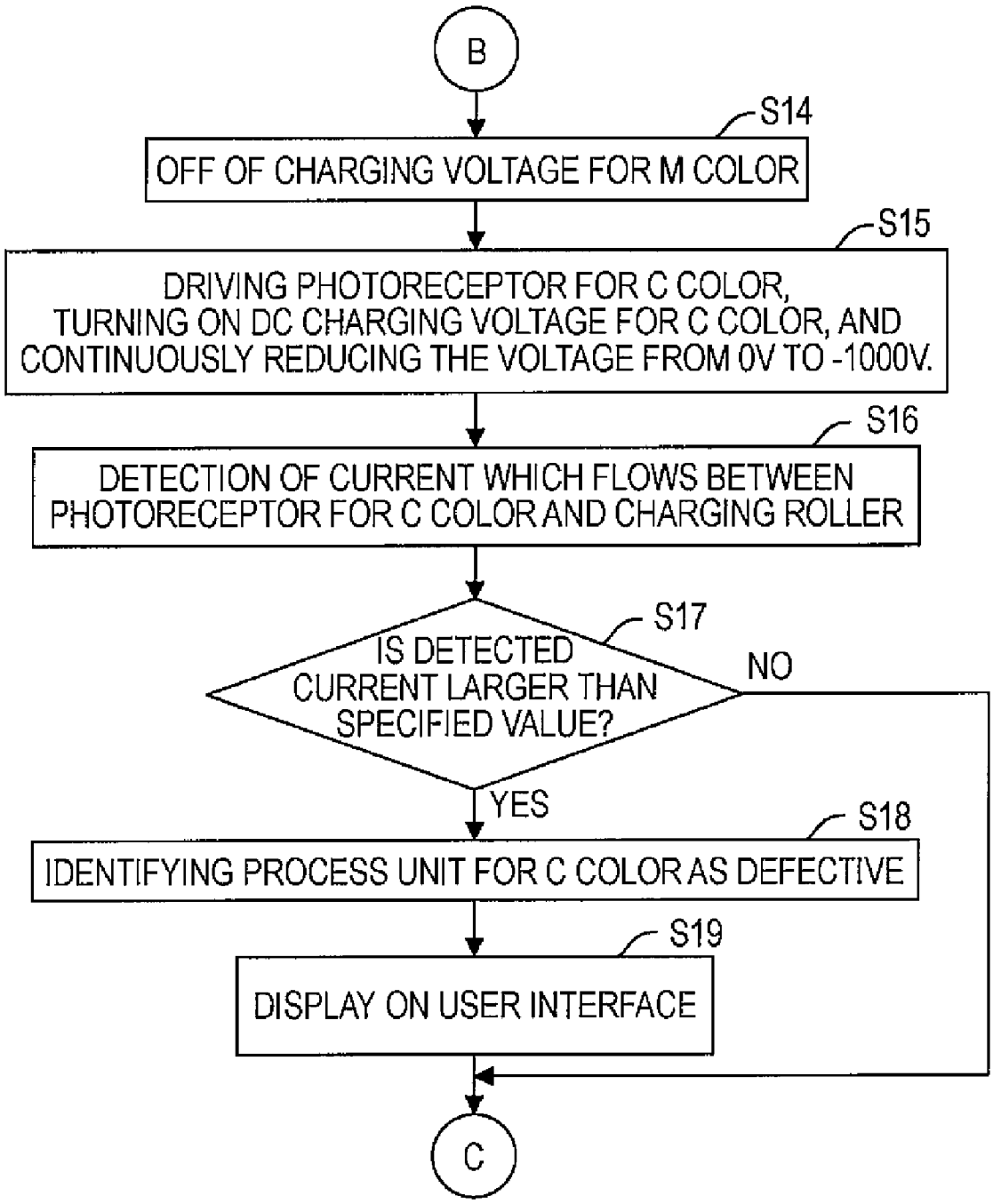
FIG. 4 is a diagram showing still another part of the flow for performing the identification method of a process unit in which leakage is generated.

Then, the DC charging voltage for M color is turned off in step S14 as show in FIG. 4. When judged that the detected current value is not more than the specified value in step S11, then goes to step S14. Then, the photoreceptor 4C for C color is driven, and the switch 12C for C color is turned on to apply the charging voltage of only DC voltage to the charging device 5C in step S15. In this case, the DC charging voltage is similarly continuously reduced from 0 V to −1000 V.

Next, the current flowing between the photoreceptor 4C and the charging roller of the charging device 5C for C color is detected by the ammeter 13 in step S16 and whether the detected current value is larger or not than the preliminarily set specified value is judged in step S17. When judged that the detected current value is larger than the specified value, the process unit 2C for C color is identified as a defective in step S18 and the result is displayed on the user interface in step 519. Herewith, the user can find out that the process unit in which leakage is generated is at least the process unit 2C for C color.

Figure 5:
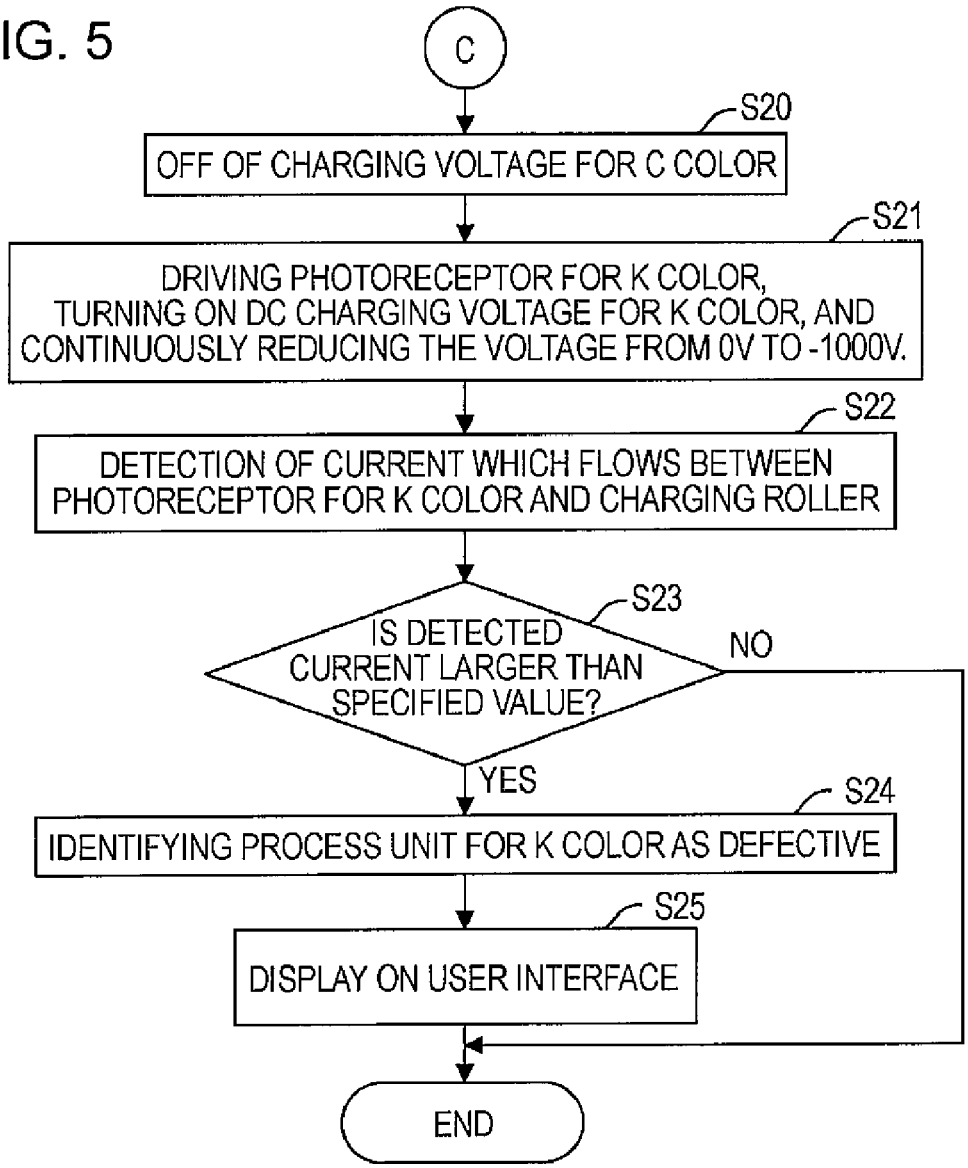
FIG. 5 is a diagram showing still another part of the flow for performing the identification method of a process unit in which leakage is generated.

Then, the DC charging voltage for C color is turned off in step S20 as show in FIG. 5. When judged that the detected current value is not more than the specified value in step S17, then goes to step S20. Then, the photoreceptor 4K for K color is driven, and the switch 12K for K color is turned on to apply the charging voltage of only DC voltage to the charging device 5K in step S21. In this case, the DC charging voltage is similarly continuously reduced from 0 V to −1000 V.

Next, the current flowing between the photoreceptor 4K and the charging roller of the charging device 5K for K color is detected by the ammeter 13 in step S22 and whether the detected current value is larger or not than the preliminarily set specified value is judged in step S23. When judged that the detected current value is larger than the specified value, the process unit 2K for K color is identified as a defective in step S24 and the result is displayed on the user interface in step S25. Herewith, the user can find out that the process unit in which leakage is generated is at least the process unit 2K for K color. Thus, the check is finished. When judged that the detected current value is not more than the specified value in step S23, the check is finished without change.

Figure 6:
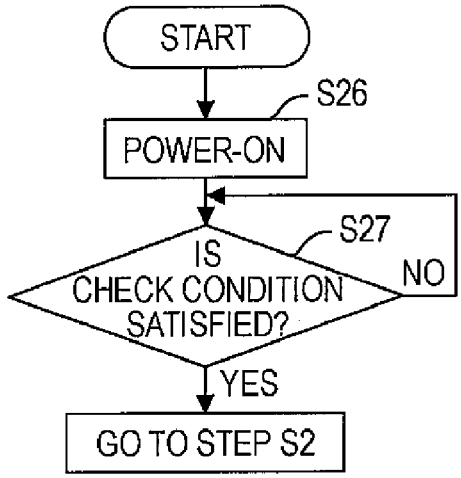
FIG. 6 is a diagram showing a part of a modification of a flow for performing the identification method of a process unit in which leakage is generated.

FIG. 6 is a diagram showing a modification of a flow for performing the identification method of the process unit.

In the identification method of the process unit in the example described above, the identification of the process unit in which leakage is generated is performed by operating the check button by user. However, as shown in FIG. 6, in the identification method of the example, the leakage in each process unit 2Y, 2M, 2C, 2K is to be automatically detected and the process unit in which leakage is generated is to be automatically identified when preliminarily set check conditions are satisfied. As for the check conditions, power-on, setting number of image formation, and the like are included. In this case, when the setting number of image formation shall be the check condition, reset is to be performed when the number of the image formation is reached to the setting number and the check is performed. Further, the setting number of the image formation may be reduced in accordance with the increase of the number to be checked.

That is, when user tunes on the power supply of the image forming device in step S26, whether the check condition is satisfied or not is judged in step S27. When judged that the check condition is not satisfied in step S27, the process of step S27 is repeated. When judged that the check condition is satisfied in step S27, then goes to the process of step S2 shown in FIG. 2, and thereafter each process of steps S2 to S25 shown in FIGS. 2 to 5 is performed and the process unit in which leakage is generated is identified.

In this manner, in the identification method of the process unit in the example, when the check condition is satisfied, the check is automatically performed. Accordingly, leakage can be detected and the process unit in which leakage is generated is simply identified without requiring any special operation.

Figure 7:
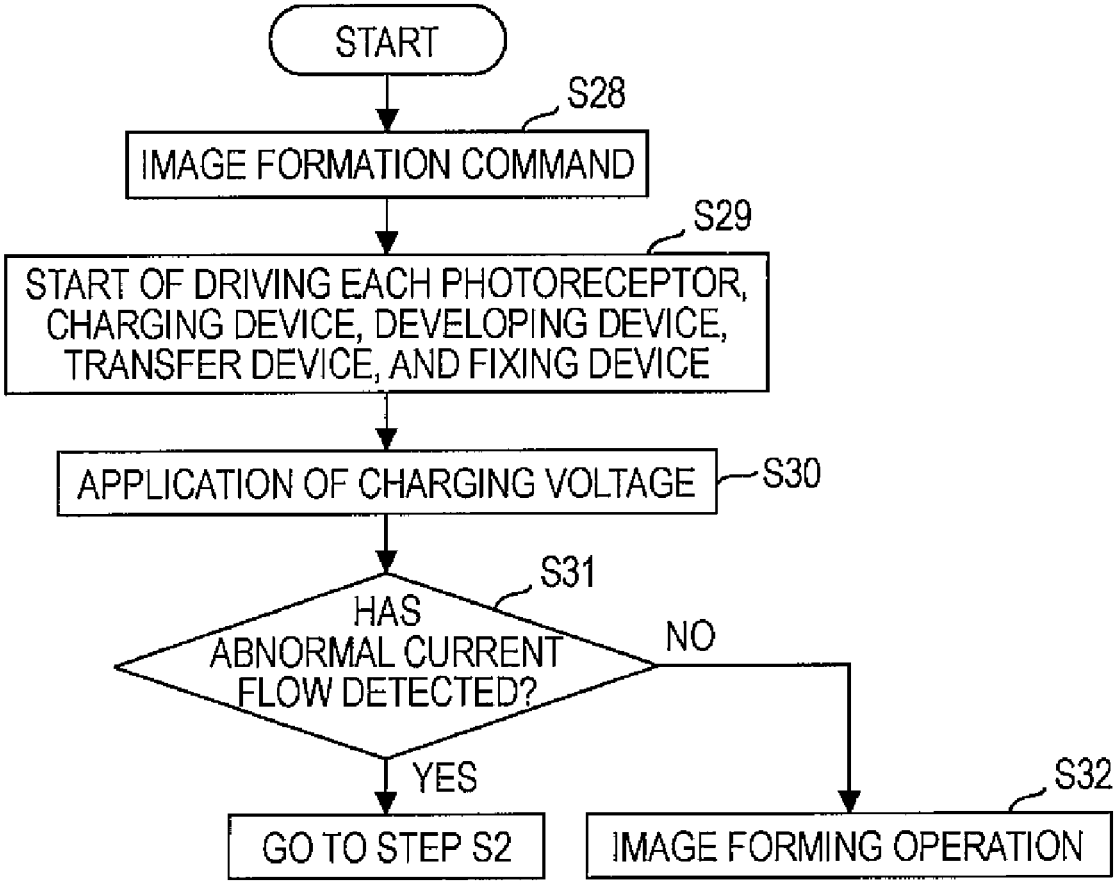
FIG. 7 is a diagram showing a part of another modification of a flow for performing the identification method of a process unit in which leakage is generated.

FIG. 7 is a diagram showing another modification of a flow for performing the identification method of the process unit.

In the identification method of the process unit of the example shown in FIG. 6 described above, leakage of each process unit 2Y, 2M, 2C, 2K is automatically detected and the process unit in which leakage is generated is automatically identified when the preliminarily set check condition is satisfied. However, as shown in FIG. 7, in the identification method of the process unit of the example, leakage of each process unit 2Y, 2M, 2C, 2K is automatically detected and the process unit in which leakage is generated is automatically identified when image forming operation is performed.

That is, when an image formation command is made to the image forming device for image formation by user in step S28, each photoreceptor 4Y, 4M, 4C, 4K, each charging device 5Y, 5M, 5C, 5K, each exposure device 6Y, 6M, 6C, 6K, each developing device 7Y, 7M, 7C, 7K, each cleaning device 8Y, 8M, 8C, 8K, the intermediate transfer belt 3, the primary and secondary transfer devices, a sheet feeder, and a fixing device are started to be driven in step S29.

Then, a charging voltage in which an AC voltage and a DC voltage are superimposed is applied to the charging roller of each charging device 6Y, 6M, 6C, 6K in step S30. Then, whether an abnormal current flow larger than the charging current at the time of normal image formation is detected or not is judged in step S31. When judged that an abnormal current flow is detected, the process goes to step S2 shown in FIG. 2, and thereafter each process of step S2 to step S5 shown in FIG. 2 to FIG. 5 is performed and the process unit in which leakage is generated is identified. When judged that no abnormal current flow is detected in step S31, the normal image forming operation is performed in step S32 and full-color image formation is performed.

In this manner, in the identification method of the process unit in the example, the check is automatically performed at image formation. Accordingly, leakage can be detected and the process unit in which leakage is generated can be easily identified without requiring a special operation.

In this manner, according to the image forming device 1 of the example, one AC voltage power supply 10 for the process units 2Y, 2M, 2C for three colors of Y color, M color, and C color is commonly provided and the DC voltage power supplies 9Y, 9M, 9C for each process units 2Y, 2M, 2C are independently provided for the each process unit 2Y, 2M, 2C. Accordingly, the number of parts can be reduced to reduce the cost, and the image forming device can be downsized and the control thereof can be facilitated.

In addition, by commonly providing one AC voltage power supply 10 to each process units 2Y, 2M, 2C, always the same AC voltage can be applied to each process units 2Y, 2M, 2C. Electrical field strength received by the photoreceptor becomes different by the magnitude of the AC voltage, so that film reducing amount of each photoreceptor 4Y, 4M, 4C closely related to the AC voltage can be approximately uniformed. Herewith, a preferable full-color image can be formed over a long period.

Further, when leakage of charging voltage is generated between the photoreceptor and the charging roller, the process unit in which leakage is generated can be surely and easily identified even when the AC voltage power supply 10 is commonly provided for each process unit 2Y, 2M, 2C. Especially, leakage can be detected and the process unit in which leakage is generated can be simply identified without requiring a special operation by automatically performing the check of leakage and the identification check of the process unit in which leakage is generated.

Figure 8:
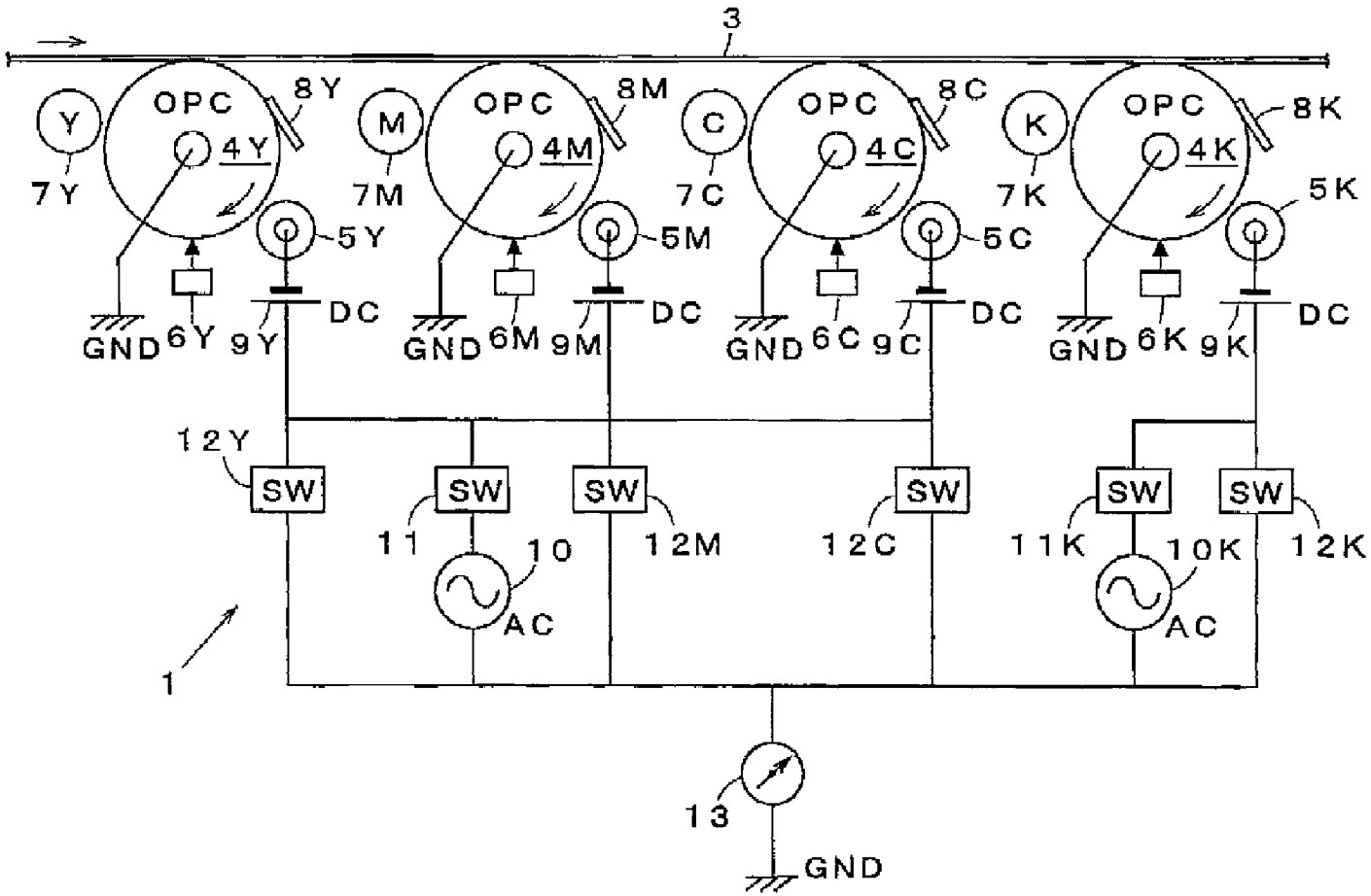
FIG. 8 is a diagram schematically and partially showing another example of the embodiment of the image forming device according to the invention.

FIG. 8 is a diagram schematically and partially showing another example of the embodiment of the image forming device according to the invention. Note that the same reference numerals are used to denote the same parts as in the example described above, and description thereof will be omitted.

In the example shown in FIG. 1 described above, one ammeter 13 is provided between each photoreceptor 4Y, 4M, 4C, 4K and the grounding GND. However, in the image forming device 1 in the example, as shown in FIG. 8, one ammeter 13 is provided between each switch 12Y, 12M, 12C, 12K, each AC voltage power supply 10, 10K, and the grounding GND.

The other structure and effect of the image forming device 1 of the example is the same as that of the image forming device 1 of the example described above, and the similar identification method as that in the example described above is performed.

Next, an experiment for confirming the effect obtained by the invention was performed.

Experimental Device

The experimental device was as shown in Table 1.

TABLE 1

| Parts | Detail | Remarks |
|---|---|---|
| Photoreceptor | Photoreceptor of LP 9000C (manufactured by Seiko Epson (Co., Ltd.)) | |
| Charging roller | Roller for non-contact AC charging<br>ϕ12 metal shaft + surface layer of 30 μm resistive layer<br>Gap member made of polyester at both ends<br>Thickness of gap was 20 μm | Resistive layer was made by mixing electrically conductive tin oxide and polyurethane with weight ratio of (1:1)<br>Resistance value was $2.0 \times 10^6\ \Omega$ |
| Cleaning blade | Cleaning blade of LP 9000C (manufactured by Seiko Epson (Co., Ltd.)) | |
| Optical writing device | Exposure unit of LP 9000C (manufactured by Seiko Epson (Co., Ltd.)) | |
| Developing device | Developing device of LP 9000C (manufactured by Seiko Epson (Co., Ltd.)) | Including toner |

TABLE 1-continued

| Parts | Detail | Remarks |
|---|---|---|
| Transfer belt | Transfer belt of LP 9000C (manufactured by Seiko Epson (Co., Ltd.)) | |
| Fixing device | Fixing device of LP 9000C (manufactured by Seiko Epson (Co., Ltd.)) | |
| AC high voltage power source | Trek (for AC output) (manufactured by US Trek) | |
| DC high voltage power source | Self manufactured product | |

As shown in Table 1, the image forming device as an experimental device includes a photoreceptor, a cleaning blade, an optical writing device as an exposure device, a developing device, an intermediate transfer belt, and a fixing device. The photoreceptor drum, the cleaning blade, the optical writing device, the developing device (including pure toner), the intermediate transfer belt, and the fixing device of color printer LP9000C manufactured by Seiko Epson (Co., Ltd.) were used. Further, the charging roller was a non-contact charging roller, and a surface layer formed by a resistive layer having thickness of 30 μm was formed on a metal shaft having a diameter of 12 mm. The resistive layer was made by mixing electrically conductive tin oxide and polyurethane with weight ratio of 1:1. The resistance value at the time was $2.0\times10^6\Omega$. Further, a tape gap member made of polyester for forming a charging gap was wound around the both ends of the surface layer. The charging gap was set to 20 μm. Trek (for AC output)(manufactured by US Trek) was used as AC high voltage power supply and a self manufactured DC high voltage power supply was used. Then, the image forming device of a tandem type shown in FIG. 1 was manufactured by using each part described above.

Experimental Conditions

Experimental conditions were as shown in Table 2.

TABLE 2

| Process | Conditions |
|---|---|
| Process speed | 210 mm/s |
| Applied charging voltage | $V_{DC}$ = −600 V<br>$V_{PP}$ = 1600 to 1900 V<br>f = 1.0 to 1.5 kHz<br>Sin curve |
| Applied developing voltage | $V_{DC}$ = −200 V<br>$V_{PP}$ = 1300 V<br>f = 3.0 kHz<br>Block pulse (50% duty) |
| Applied transfer voltage | +200 V |

As shown in Table 2, experimental conditions were as described below. The process speed was 210 mm/sec, the applied charging voltage was a superimposed voltage of a DC voltage and an AC voltage, the DC voltage $V_{DC}$=−600 V, the AC voltage $V_{PP}$=1600 to 1900 V, the frequency of the AC voltage f=1.0 to 1.5 kHz sine curve, the applied developing voltage was also a superimposed voltage of a DC voltage and an AC voltage, the DC voltage $V_{DC}$=−200 V, the AC voltage $V_{PP}$=1300 V, the frequency of the AC voltage f=3.0 kHz block pulse (50% duty), and applied transfer voltage was +200 V.

Printing Tests

The printing tests of No. 1 to No. 4 were performed by using the experimental device described above and under the experimental conditions shown in Table 3.

TABLE 3

| No. | Photoreceptor | Applied charging voltage ($V_{DC}$, $V_{PP}$, f) | Results |
|---|---|---|---|
| 1 | For all four colors; normal products | For K (−600, 1800, 1.3 kHz) For CMY (−600, 1750, 1.3 kHz) | No problem when printing 1K A4 papers |
| 2 | For KMY; normal products For C; a product in which a hole whose size is 0.2 mm is made | For K (−600, 1900, 1.5 kHz) For CMY (−600, 1750, 1.5 kHz) | Leakage was generated when printing first A4 paper |
| 3 | For KCM; normal products For Y; a product in which a hole whose size is 0.5 mm is made | For K (−600, 1800, 1.2 kHz) For CMY (−600, 1700, 1.2 kHz) | Leakage was generated when printing first A4 paper |
| 4 | For KCY; normal products For M; a product in which a hole whose size is 0.7 mm is made | For K (−600, 1800, 1.3 kHz) For CMY (−600, 1800, 1.4 kHz) | Leakage was generated when printing first A4 paper |

As shown in FIG. 3, in the printing test of No. 1, each photoreceptor 4Y, 4M, 4C, 4K for four colors was a normal product. Further, in the printing test of No. 2, each photoreceptor 4Y, 4M, 4K for three colors was a normal product but the photoreceptor 4C for cyan color was a product in which a hole having a diameter of 0.2 mm was made. Further, in the printing test of No. 3, each photoreceptor 4M, 4C, 4K for three colors was a normal product but the photoreceptor Y for yellow color was a product in which a hole having a diameter of 0.5 mm was made. Further, in the printing test of No. 4, each photoreceptor 4Y, 4C, 4K for three colors was a normal product but the photoreceptor M for magenta color was a product in which a hole having a diameter of 0.7 mm was made.

In addition, in the printing test of No. 1, as for the applied charging voltage for K color, $V_{DC}$=−600 V, $V_{PP}$=1800 V, frequency of AC voltage f=1.3 kHz sine curve. In addition, as for Y, M, C colors, $V_{DC}$=−600 V, $V_{PP}$=1750 V, frequency of AC voltage f=1.3 kHz sine curve. Further, in the printing test of No. 2, as for the applied charging voltage for K color, $V_{DC}$=−600 V, $V_{PP}$=1900 V, frequency of AC voltage f=1.5 kHz sine curve. In addition, as for Y, M, C colors, $V_{DC}$=−600 V, $V_{PP}$=1750 V, frequency of AC voltage f=1.5 kHz sine curve. Further, in the printing test of No. 3, as for the applied charging voltage for K color, $V_{DC}$=−600 V, $V_{PP}$=1800 V, frequency of AC voltage f=1.2 kHz sine curve. In addition, as for Y, M, C colors, $V_{DC}$=−600 V, $V_{PP}$=1700 V, frequency of AC voltage f=1.2 kHz sine curve. Further, in the printing test of No. 4, as for the applied charging voltage for K color, $V_{DC}$=−600 V, $V_{PP}$=1800 V, frequency of AC voltage f=1.3 kHz sine curve. In addition, as for Y, M, C colors, $V_{DC}$=−600 V, $V_{PP}$=1600 V, frequency of AC voltage f=1.4 kHz sine curve.

The printing test was performed under the circumstance where the temperature was 23° C. and humidity was 65% R.H. A halftone full page solid image was printed on an A4 paper. The test result is shown in Table 3. As shown in Table 3, in the printing test of No. 1, no image defect was occurred even when 1 k papers were printed. Accordingly, no leakage was generated and there was no problem. In addition, in the printing test of No. 2, image defect was occurred and leakage was generated when a first paper was printed. Further, also in the printing test of No. 3, image defect was occurred and leakage was generated similarly when a first paper was printed. Further, also in the printing test of No. 4, image defect was occurred and leakage was generated similarly when a first paper was printed.

Next, the experiment for identifying the process unit in which leakage was generated was performed. The applied DC voltage and the current value in this case were as shown in Table 4. Further, in the identification experiment of No. 1 to 4, the same photoreceptor as each photoreceptor used in the printing tests of No. 1 to 4 described above was used.

TABLE 4

| No. | Photoreceptor | Applied DC voltage and current value | Results |
|---|---|---|---|
| 1 | For all four colors; normal products | CMY 0 to −1000 V was applied and each value shown by ammeter was all not more than 20 μA | Judged as no leakage |
| 2 | For KMY; normal products For C; a product in which a hole whose size is 0.2 mm is made | MY 0 to −1000 V was applied and values for MY shown by ammeter were all not more than 20 μA C −800 V was applied and current of 150 μA was measured for each time charging roller was rotated | Judged that leakage was in unit for C, and detection was successful |
| 3 | For KCM; normal products For Y; a product in which a hole whose size is 0.5 mm is made | CM 0 to −1000 V was applied and values for CM shown by ammeter were all not more than 20 μA Y −700 V was applied and current of 160 μA was measured for each time charging roller was rotated | Judged that leakage was in unit for Y, and detection was successful |
| 4 | For KCY; normal products For M; a product in which a hole whose size is 0.7 mm is made | CY 0 to −1000 V was applied and values for CM shown by ammeter were all not more than 20 μA M −700 V was applied and the current of 190 μA was measured for each time charging roller was rotated | Judged that leakage was in unit for M, and detection was successful |

The current which flows between each photoreceptor 4Y, 4M, 4C and each charging device 5Y, 5M, 5C for three colors was detected by manually performing each process of steps S2 to S4, S8 to S10, and S14 to S16 shown in FIGS. 2 to 4. The detected result of the current and the identification result of the process unit in which leakage was generated are shown in FIG. 4.

As shown in Table 4, in the identification experiment of No. 1 in which all products for four colors were normal, all of each detected current for the process units 2Y, 2M, 2C for three colors were not more than 20 μA and judged that no leakage was generated. In addition, in the identification experiment of No. 2, all of each current for the process units 2Y, 2M for two colors were not more than 20 μA. However, the detected current for the process unit 2C for C color when the DC voltage of −800 V was applied was 150 μA for each time the charging roller was rotated, so that it could be identified that the process unit in which leakage was generated was the process unit 2C for C color. Further, in the identification experiment of No. 3, all of each current for the process units 2M, 2C for two colors were not more than 20 μA. However, the detected current for the process unit 2Y for Y color when the DC voltage of −700 V was applied was 160 μA for each time the charging roller was rotated, so that it could be identified that the process unit in which leakage was generated was the process unit 2Y for Y color. Further, in the identification experiment of No. 4, all of each current for the process units 2Y, 2C for two colors was not more than 20 μA. However, the detected current for the process units 2M for M color when the DC voltage of −700 V was applied was 190 μA for each time the charging roller was rotated, so that it could be identified that the process unit in which leakage was generated was the process unit 2M for M color.

According to the experiment, it is demonstrated that the process unit in which leakage is generated can be identified when leakage is generated at least at one of each process unit 2Y, 2M, 2C, even when one AC power supply 10 is commonly provided to each process unit 2Y, 2M, 2C for three colors.

Note that the invention is not limited to the non-contact charging system and it goes without saying that the similar result can also be obtained by a contact charging system. Further, the process unit is required only to include at least a photoreceptor. Further, the image forming device of the invention can be applied to any image forming device as far as the process units for a plurality of colors more than at least two colors are arranged in a tandem manner.

According to the image forming device of the invention constituted in such a manner, one alternating power supply for applying alternating voltage to each charging device for a plurality of colors is commonly provided and a direct power supply for applying direct voltage to each charging device for the plurality of colors is independently provided for each charging device for the plurality of colors, so that a number of parts can be reduced to reduce the cost, the image forming device can be downsized, and the control thereof can be facilitated.

In addition, by commonly providing one alternating power supply to each charging device for the plurality of colors, the same alternating voltage can be always applied to each charging device. Electrical field strength received by an image carrying body is different in accordance with the magnitude of the alternating voltage, so that film reducing amount of each image carrying body which closely related to the alternatively voltage can be approximately uniformed. Herewith, a preferable color image or full-color image can be formed for a long period.

Further, when leakage of charging voltage is generated between the image carrying body and charging device, the image carrying body in which leakage is generated can be surely and easily identified even when the alternating power supply is commonly provided for each charging device. Especially, leakage can be detected and the image carrying body in which leakage is generated can be simply identified without requiring a special operation by automatically performing the check of leakage and the identification check of the image carrying body in which leakage is generated.

The image forming device of the invention can be preferably used for an electrophotographic device, an electrostatic copier, a printer, a facsimile, and the like in which a DC power supply for a process unit for each color is independently arranged and an AC power supply is commonly arranged for the process units for three colors in the full-color image forming device of a tandem type.

What is claimed is:

1. An image forming device in which image carrying bodies on which an electrostatic latent image is respectively formed in accordance with for each a plurality of colors are arranged in a tandem manner, in which a charging voltage in which an alternating voltage and a direct voltage are superimposed is applied to charging devices which respectively charge each image carrying body, and in which a color image is formed by sequentially overlapping a toner image of each color formed on each image carrying body on an intermediate transfer medium or a transfer material, wherein a direct voltage power supply for applying a direct voltage to the charging device for each color is independently provided for each charging device for each color, and an alternating voltage power supply for applying an alternating voltage to the charging device for each color is commonly provided to the charging device for each color, a current detecting section for detecting a current which flows between the each image carrying body and the each charging device is provided, and a control device is provided which judges that the image carrying body is damaged when a current value detected by the current detecting section is not less than a preliminarily set specified value when a direct voltage is sequentially independently applied to the charging device for each color when leakage of charging voltage is generated.

2. The image forming device according to claim 1, wherein the direct voltage respectively sequentially independently applied to the charging device for each color when leakage of charging voltage is generated is continuously changed from 0 V.

3. The image forming device according to claim 1, wherein an image carrying body for Meek black is further arranged in a tandem manner to each image carrying body for the plurality of colors, and a direct voltage power supply and an alternating voltage power supply for applying a direct voltage and an alternating voltage to the charging device to the image carrying body for black are respectively independently provided from the direct voltage power supply and the alternating voltage power supply to each image carrying body for the plurality of colors.

4. The image forming device according to claim 1, wherein the each image carrying body is respectively constituted as a process unit.

* * * * *